US008312852B2

(12) United States Patent
Yang et al.

(10) Patent No.: US 8,312,852 B2
(45) Date of Patent: Nov. 20, 2012

(54) VARIABLE TAPPET

(75) Inventors: Jei Choon Yang, Yongin (KR); Gee Wook Shin, Hwaseong (KR); Sang Won Kim, Seoul (KR); Jin Kook Kong, Suwon (KR); Soo Hyung Woo, Yongin (KR); Byong Young Choi, Incheon (KR); Young Hong Kwak, Suwon (KR); Jin Soon Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 245 days.

(21) Appl. No.: 12/846,593

(22) Filed: Jul. 29, 2010

(65) Prior Publication Data

US 2011/0132305 A1 Jun. 9, 2011

(30) Foreign Application Priority Data

Dec. 4, 2009 (KR) ..... 10-2009-0120123
Apr. 8, 2010 (KR) ..... 10-2010-0032439

(51) Int. Cl.
*F01L 1/14* (2006.01)

(52) U.S. Cl. ..... 123/90.48; 123/90.52; 123/90.16

(58) Field of Classification Search ..... 123/90.48, 123/90.52, 90.59, 90.55, 90.16
See application file for complete search history.

(56) References Cited

U.S. PATENT DOCUMENTS 5,361,733 A * 11/1994 Spath et al. ..... 123/90.16

* cited by examiner

*Primary Examiner* — Zelalem Eshete
(74) *Attorney, Agent, or Firm* — Morgan, Lewis & Bockius LLP

(57) ABSTRACT

The present invention relates to a variable tappet, and the variable tappet may include an inner tappet body of which a latching member connecting hole is formed thereto, a protrude portion formed to the latching member connecting hole, an outer tappet body which is disposed around the inner tappet body and slidable to the inner tappet body and a latching member which is disposed to the outer tappet body and selectively connected to the latching member connecting hole.

13 Claims, 17 Drawing Sheets

VARIABLE TAPPET

CROSS-REFERENCE TO RELATED APPLICATION

The present application claims priority to Korean Patent Application No. 10-2009-0120123 filed in the Korean Intellectual Property Office on Dec. 4, 2009 and 10-2010-0032439 filed in the Korean Intellectual Property Office on Apr. 8, 2010, the entire contents of which is incorporated herein for all purposes by this reference.

BACKGROUND OF THE INVENTION

1. Field of the Invention

The present invention relates to a variable tappet. More particularly, the present invention relates to a variable tappet which may change valve lift according to engine operation condition.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches has been undertaken. For example, research has been undertaken for a variable tappet that enables different lifts depending on an engine speed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable tappet which may change valve lift according to engine operation condition.

In an aspect of the present invention, the variable tappet may include an inner tappet body of which a latching member connecting hole is formed thereto, a protrude portion formed in the latching member connecting hole, an outer tappet body which is disposed around the inner tappet body and slidable to the inner tappet body, and a latching member which is slidably mounted to the outer tappet body and selectively connected to the latching member connecting hole.

The latching member may include a latching pin of which a latching pin hole is formed therein toward the inner tappet body and which is slidably disposed within a hydraulic pressure chamber formed in the outer tappet body, wherein a hydraulic pressure supply portion selectively supplies hydraulic pressure to the hydraulic pressure chamber to push the latching pin, an elastic member disposed within the latching pin hole, and a plate which is slidably disposed within the latching pin hole and elastically supported by the elastic member, wherein a diameter of the plate is larger than distance between the latching pin connecting hole and the protrude portion.

The outer tappet body may be connected to a valve, and the inner tappet body is elastically supported by a lost motion spring or the inner tappet body may be connected to a valve, and the outer tappet body is elastically supported by a lost motion spring.

In another aspect of the present invention, the variable tappet may include an inner tappet body, an outer tappet body which is disposed around the inner tappet body and slidable to the inner tappet body and of which a latching member connecting hole is formed thereto, a protrude portion formed in the latching member connecting hole, and a latching member which is slidably disposed to the inner tappet body and selectively connected to the latching member connecting hole.

The latching member may include a latching pin of which a latching pin hole is formed therein toward the outer tappet body and which is disposed within a hydraulic pressure chamber, wherein the hydraulic pressure chamber is formed to the inner tappet body and hydraulic pressure is selectively supplied thereto by a hydraulic pressure supply portion, an elastic member disposed within the latching pin hole, and a plate which is slidably disposed within the latching pin hole and elastically supported by the elastic member, wherein a diameter of the plate is larger than distance between the latching pin connecting hole and the protrude portion.

The outer tappet body may be connected to a valve, and the inner tappet body is elastically supported by a lost motion spring or the inner tappet body may be connected to a valve, and the outer tappet body is elastically supported by a lost motion spring.

In further another aspect of the present invention, the variable tappet may include an outer tappet body of which a latching member connecting hole is formed thereto, a protrude portion formed in the latching member connecting hole, an inner tappet body which is disposed within the outer tappet body and slidable to the outer tappet body and of which a latching member guide hole is formed thereto, a latching member which is slidably disposed within the latching member guide hole and selectively connected to the latching member connecting hole, and a plunger which is disposed to a hydraulic pressure chamber formed to the outer tappet body and selectively inserts the latching member into the latching member connecting hole.

The latching member may include a latching pin of which a latching pin hole is formed therein toward the outer tappet body and which is selectively connected to the latching member connecting hole, a plate which is slidably disposed within the latching pin hole toward the protrude portion, and an elastic member which is disposed within the latching pin hole and elastically supports the plate therein, wherein a knob is formed to an end of the latching pin for the plate not to be separated from the latching pin, and wherein a diameter of the latching pin is substantially same as a diameter of the plunger.

An upper surface of the inner tappet body, which contacts a cam, may be elongatedly formed along rotation direction of the cam.

A guide protrude portion may be formed to the inner tappet body along length direction of the variable tappet and slidably coupled to the outer tappet body.

The variable tappet according to the exemplary embodiments of the present invention may reduce manufacturing cost with simple scheme and prevent damage of a latching pin by prevent of an interference of the latching pin.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
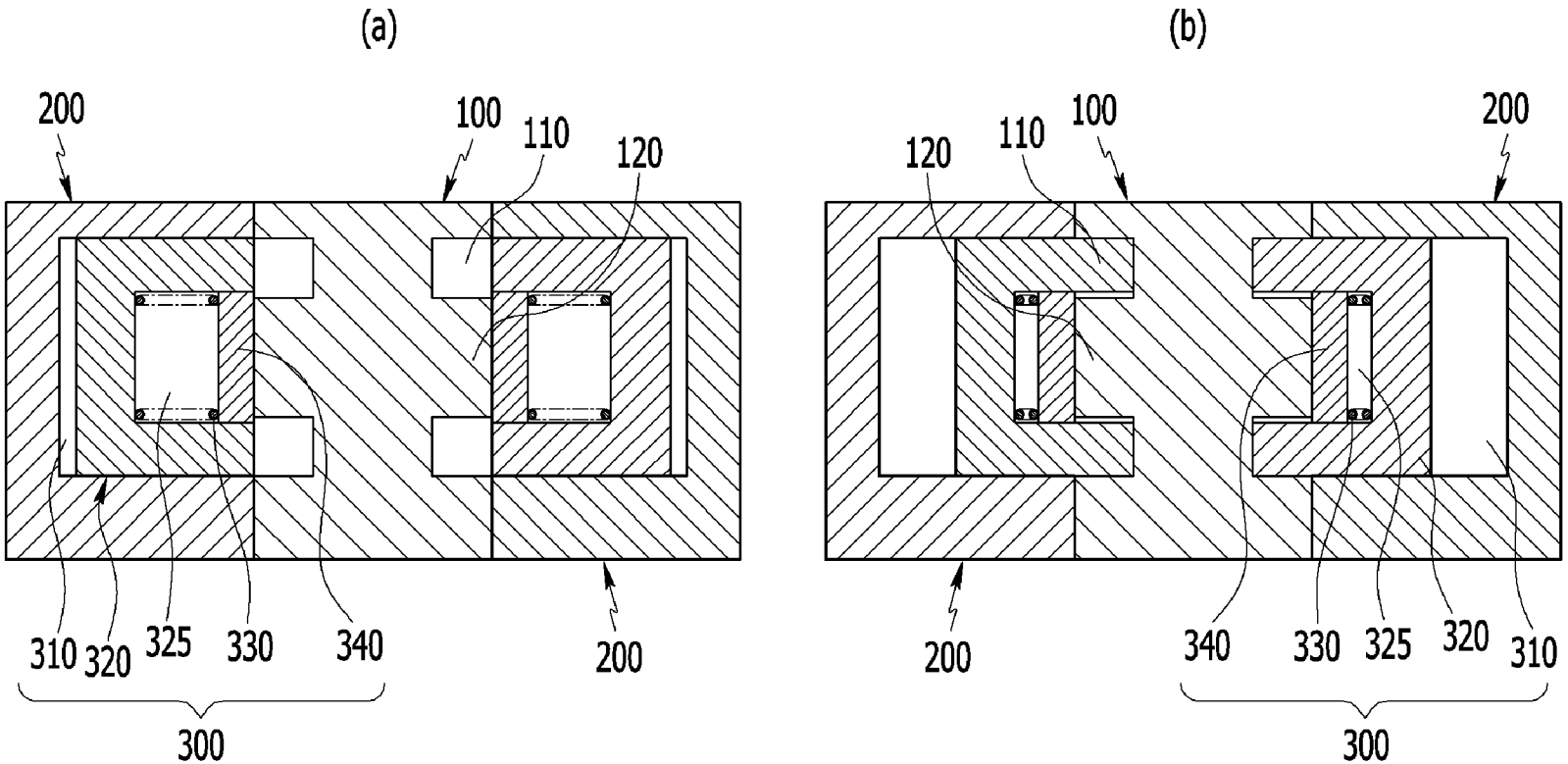
FIG. 1 is a cross-sectional view of an exemplary variable tappet according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Exemplary embodiments of the present invention will hereinafter be described in detail with reference to the accompanying drawings.

Hereinafter, for better comprehension and ease of description, the same reference number will indicate the same element.

Figure 2:
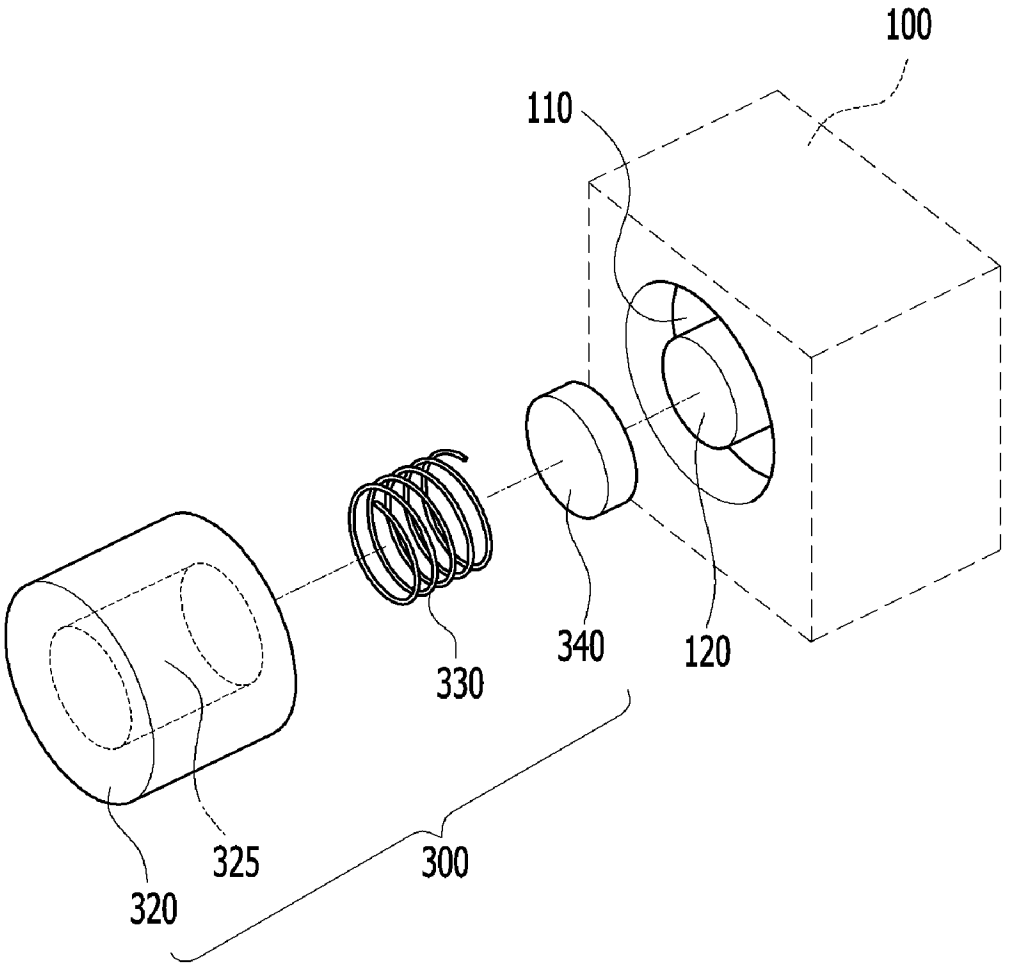
FIG. 2 is a drawing showing a latching member of the exemplary variable tappet according to the present invention.
Figure 3:
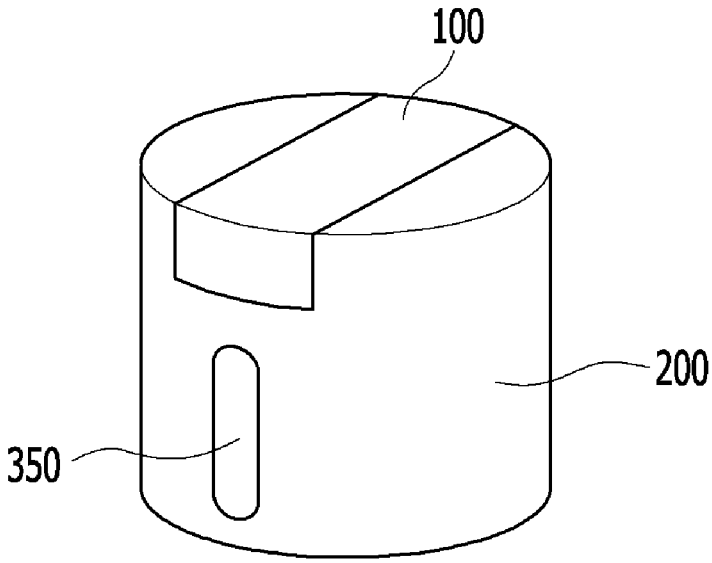
FIG. 3 is a perspective view of the exemplary variable tappet according to the present invention.
Figure 4:
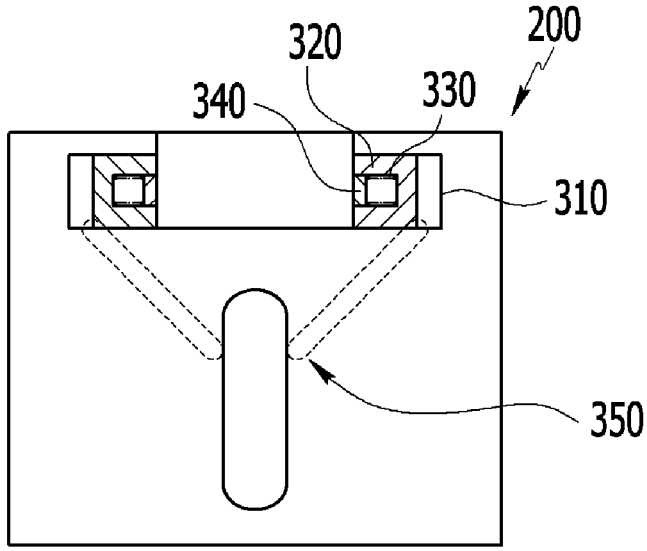
FIG. 4 is a cross-sectional view of an outer tappet body of the exemplary variable tappet according to the present invention.

FIG. 1 is a cross-sectional view of a variable tappet according to the first exemplary embodiment of the present invention and FIG. 2 is a drawing showing a latching member of the variable tappet according to the first exemplary embodiment of the present invention. FIG. 3 is a perspective view of the variable tappet according to the first exemplary embodiment of the present invention and FIG. 4 is a cross-sectional view of an outer tappet body of the variable tappet according to the first exemplary embodiment of the present invention.

Referring to FIG. 1 to FIG. 4, a variable tappet according to the first exemplary embodiment of the present invention includes an inner tappet body 100 of which a latching member connecting hole 110 is formed thereto, a protrude portion 120 formed to the latching member connecting hole 110, an outer tappet body 200 which is disposed around the inner tappet body 100 and slidable to the inner tappet body 100 and a latching member 300 which is disposed to the outer tappet body 200 and selectively connected to the latching member connecting hole 110.

The latching member 300 includes a hydraulic pressure chamber 310 formed to the outer tappet body 200, a latching pin 320 of which a latching pin hole 325 is formed toward the inner tappet body 100 and which is disposed within the hydraulic pressure chamber 310, a return spring 330 disposed within the latching pin 320, a plate 340 which is disposed within the latching pin hole 325 and elastically supported by the return spring 330 and a hydraulic pressure supply portion 350 which selectively supplies hydraulic pressure to the hydraulic pressure chamber 310.

A diameter of the plate 340 is larger than distance between the latching pin connecting hole 110 and the protrude portion 120 so that the plate 340 is not inserted into between the latching pin connecting hole 110 and the protrude portion 120.

A general tappet does not have a scheme corresponding to the protrude portion 120 of the variable tappet of the exemplary embodiment with complicated scheme so that manufacturing cost is high.

While the variable tappet according to the first exemplary embodiment of the present invention has the protrude portion 120 between the inner tappet body 100 and the outer tappet body 200, the latching pin 320 may be prevented from damaging by interference during operation of the latching pin 320.

That is, a diameter of the latching pin 320 may be larger than the others, and limitation of protruding of the inner tappet body 100 and the outer tappet body 200, so called differential stroke, may be reduced. That means the inner tappet body 100 may protrude relatively further than the others and vise versa.

The hydraulic pressure supply portion 350 is formed to the outer tappet body 200 as hydraulic lines, is controlled by an ECU (electronic control unit) and supplies hydraulic pressure to the hydraulic pressure chamber 310. While the operation and control of the ECU are obvious to a skilled person in the art so that detailed description will be omitted.

Figure 5:
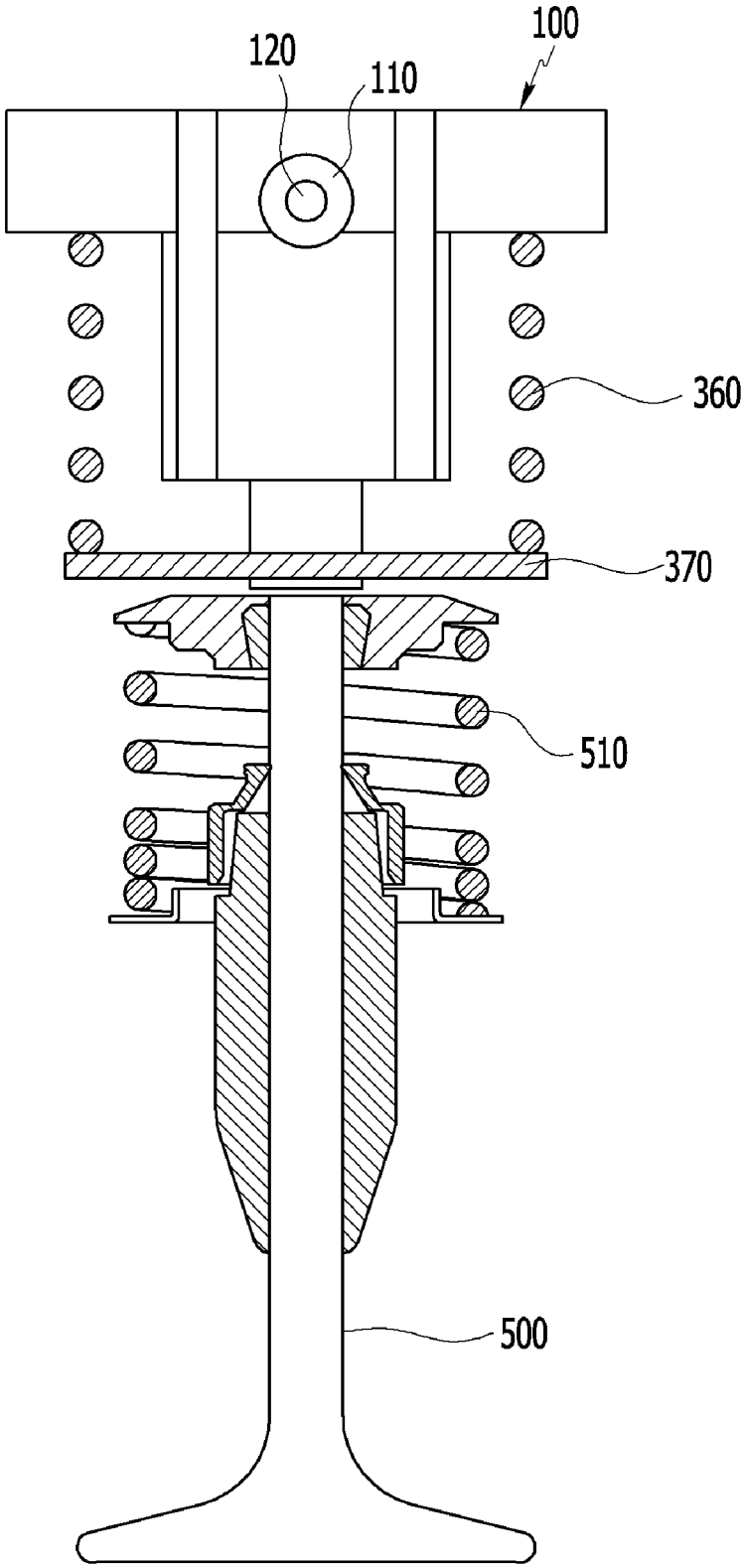
FIG. 5 is a drawing of an inner tappet body and a valve of the exemplary variable tappet according to the present invention.

FIG. 5 is a drawing of an inner tappet body and a valve of the variable tappet according to the first exemplary embodiment of the present invention.

As shown in FIG. 5, a valve 500 and a valve spring 510 are disposed under the inner tappet body 100 and a valve seat 370 and a lost motion spring 360 elastically supports the inner tappet body 100.

Figure 6:
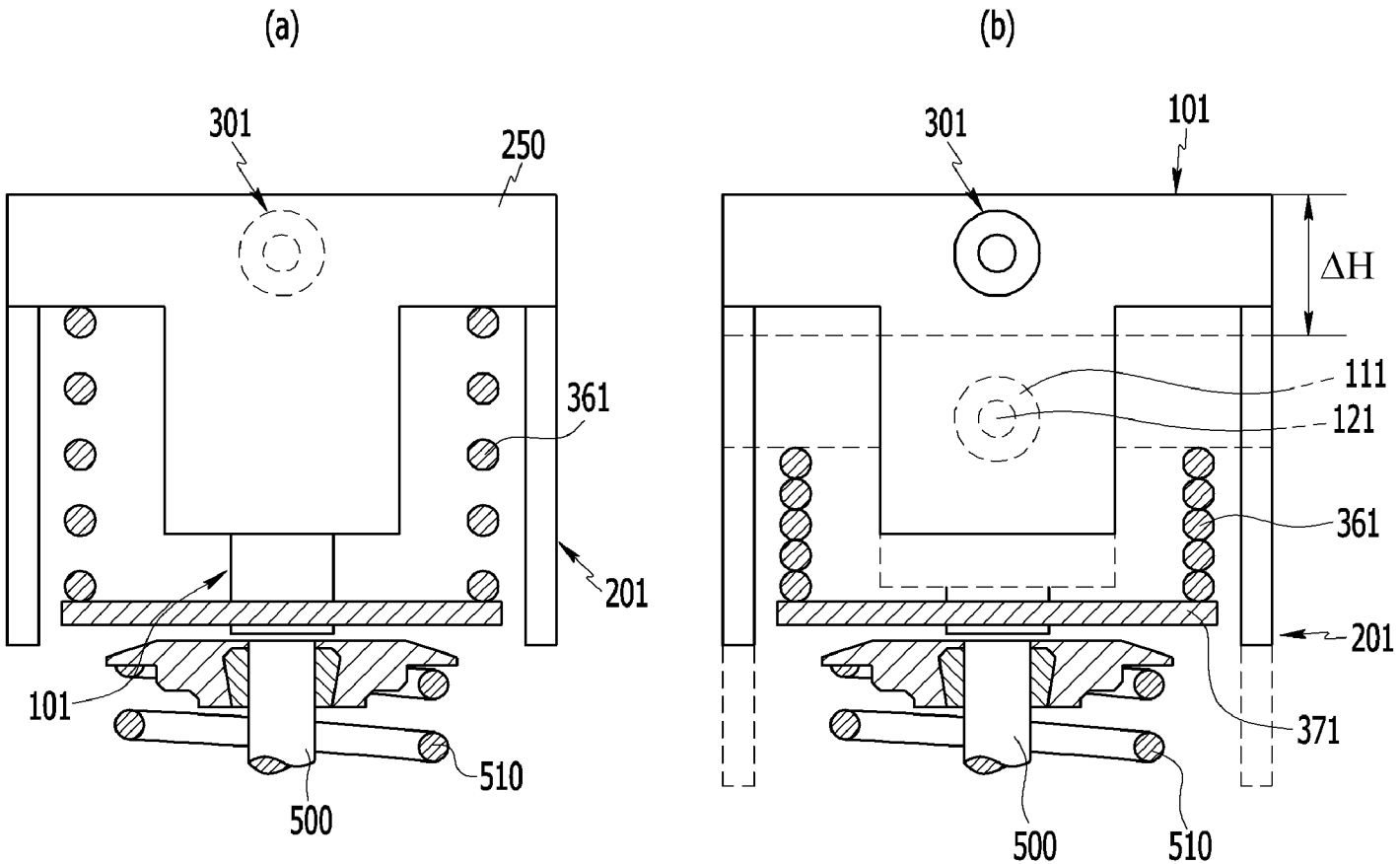
FIG. 6 is a drawing showing an exemplary variable tappet according to the present invention.
Figure 10:
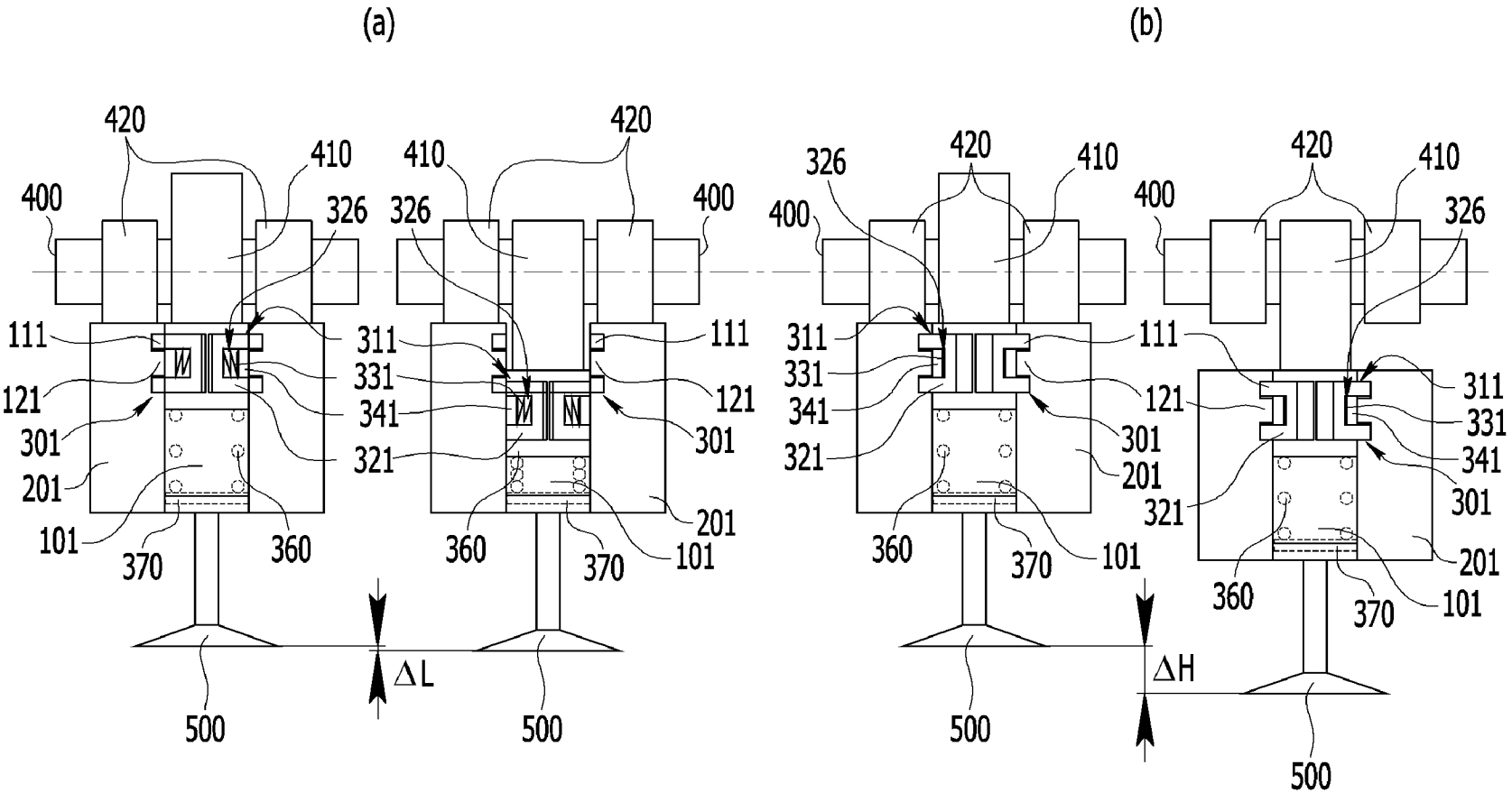
FIG. 10 is a drawing showing operation of the exemplary variable tappet according to the present invention.

FIG. 6 is a drawing showing a variable tappet according to the second exemplary embodiment of the present invention and FIG. 10 is a drawing showing operation of the variable tappet according to the second exemplary embodiment of the present invention.

Referring to FIG. 6 and FIG. 10, a variable tappet according to the second exemplary embodiment of the present invention includes an inner tappet body 101, an outer tappet body 201 which is disposed around the inner tappet body 101 and slidable to the inner tappet body 101 and of which a latching member connecting hole 111 is formed thereto, a protrude portion 121 formed to the latching member connecting hole 111 and a latching member 301 which is disposed to the inner tappet body 101 and selectively connected to the latching member connecting hole 111.

The latching member 301 includes a hydraulic pressure chamber 311 formed to the inner tappet body 101, a latching pin 321 of which a latching pin hole 326 is formed toward the outer tappet body 201 and which is disposed within the hydraulic pressure chamber 311, a return spring 331 disposed within the latching pin 321, a plate 341 which is disposed within the latching pin hole 326 and elastically supported by the return spring 331 and a hydraulic pressure supply portion which selectively supplies hydraulic pressure to the hydraulic pressure chamber (referring to FIG. 4).

Comparing the second exemplary embodiment of the present invention with the first exemplary embodiment of the present invention, scheme of the latching member connecting hole 111, protrude portion 121 and latching member 301 are changed and the hydraulic pressure supply portion supplies hydraulic pressure to the hydraulic pressure chamber 311 formed to the inner tappet body 101 in the second exemplary embodiment.

Figure 7:
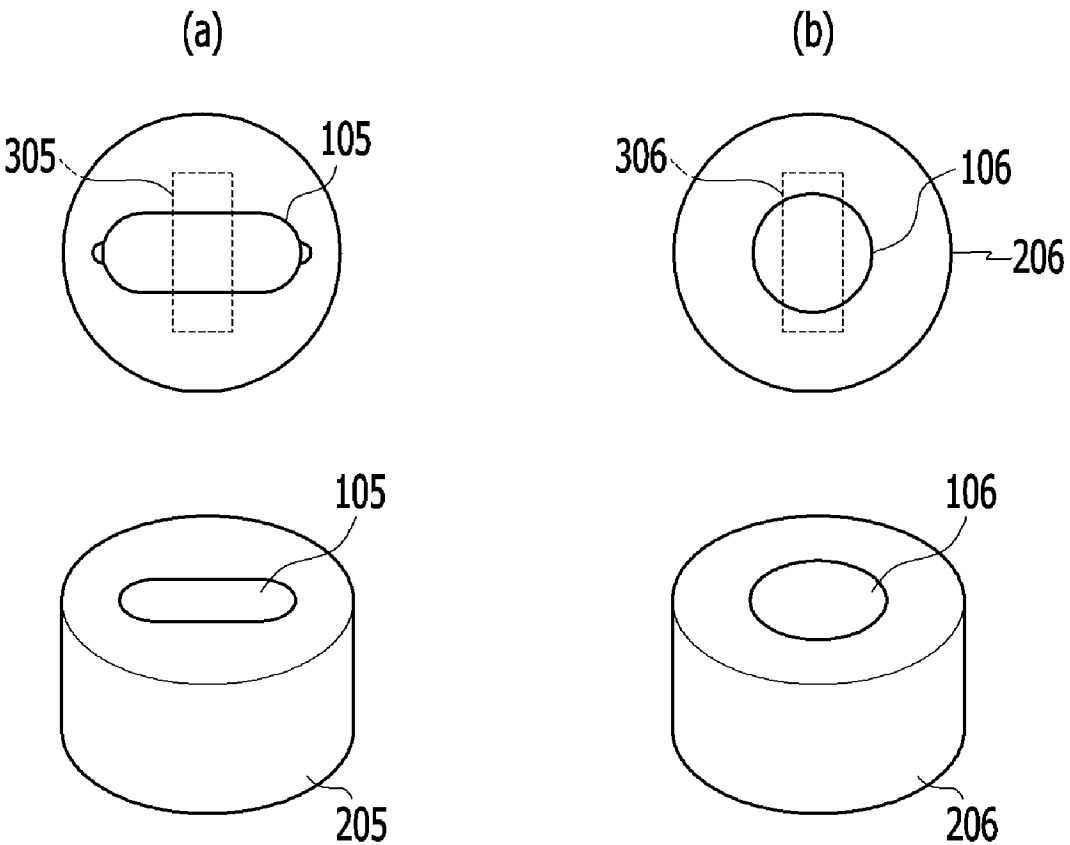
FIG. 7 is a drawing showing exemplary variations of the present invention.

FIG. 7 is a drawing showing exemplary variations of the first exemplary embodiment of the present invention.

As shown (a) and (b) of FIG. 7, an inner tappet body 105 and 106 is disposed within an outer tappet body 205 and 206, a latching member 305 and 306 selectively connects the inner tappet body 105 and 106 with the outer tappet body 205 and 206 and the inner tappet body 105 may be elongatedly formed along rotating direction of a cam or the inner tappet body 106 is formed as a circular cylinder 106.

That is, in the exemplary embodiments of the present invention, design degree of freedom and layout can be broadened.

Figure 8:
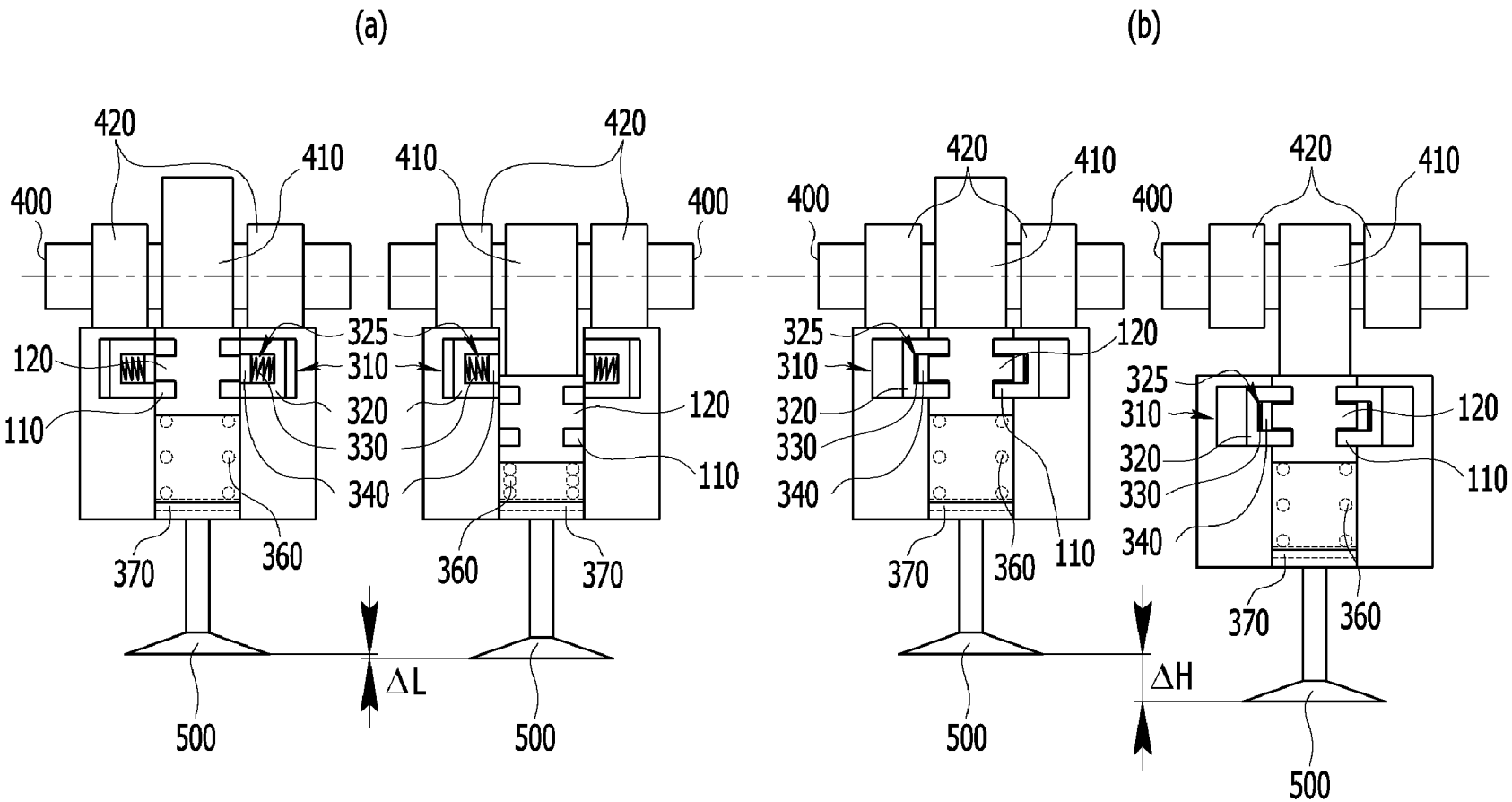
FIG. 8 is a drawing showing operation of the exemplary variable tappet according to the present invention.

FIG. 8 is a drawing showing operation of the variable tappet according to the first exemplary embodiment of the present invention.

Referring to FIG. 1, FIG. 5 and FIG. 8, a variable valve lift apparatus is provided with the variable tappet according to the first exemplary embodiment of the present invention.

The variable valve lift apparatus provided with the variable tappet according to the first exemplary embodiment of the present invention includes a camshaft 400, a plurality of low lift cam 420 disposed to the camshaft 200, and a high lift cam 410 disposed between the low lift cams 420. The inner tappet body 100 contacts to the high lift cam 410 and the outer tappet body 200 selectively contacts the low lift cam 420.

The inner tappet body 100 is elastically supported by the valve seat 370 and the lost motion spring 360.

In the low lift mode, as shown in (a) of FIG. 8, hydraulic pressure is not supplied to the hydraulic pressure chamber 310.

Thus, the latching pin 320 is separated from the latching member connecting hole 110, the inner tappet body 100 outputs no useful work (lost motion), and the valve 500 is opened by the low lift cam 420 forming reduced valve lift ($\Delta L$).

In the high lift mode, as shown in (b) of FIG. 8, hydraulic pressure is supplied to the hydraulic pressure chamber 310.

And thus, the latching pin 320 is inserted into the latching member connecting hole 110, the inner tappet body 100 reciprocates with the outer tappet body 200 and the valve 500 is opened by the high lift cam 410 forming increased valve lift ($\Delta H$).

Figure 9:
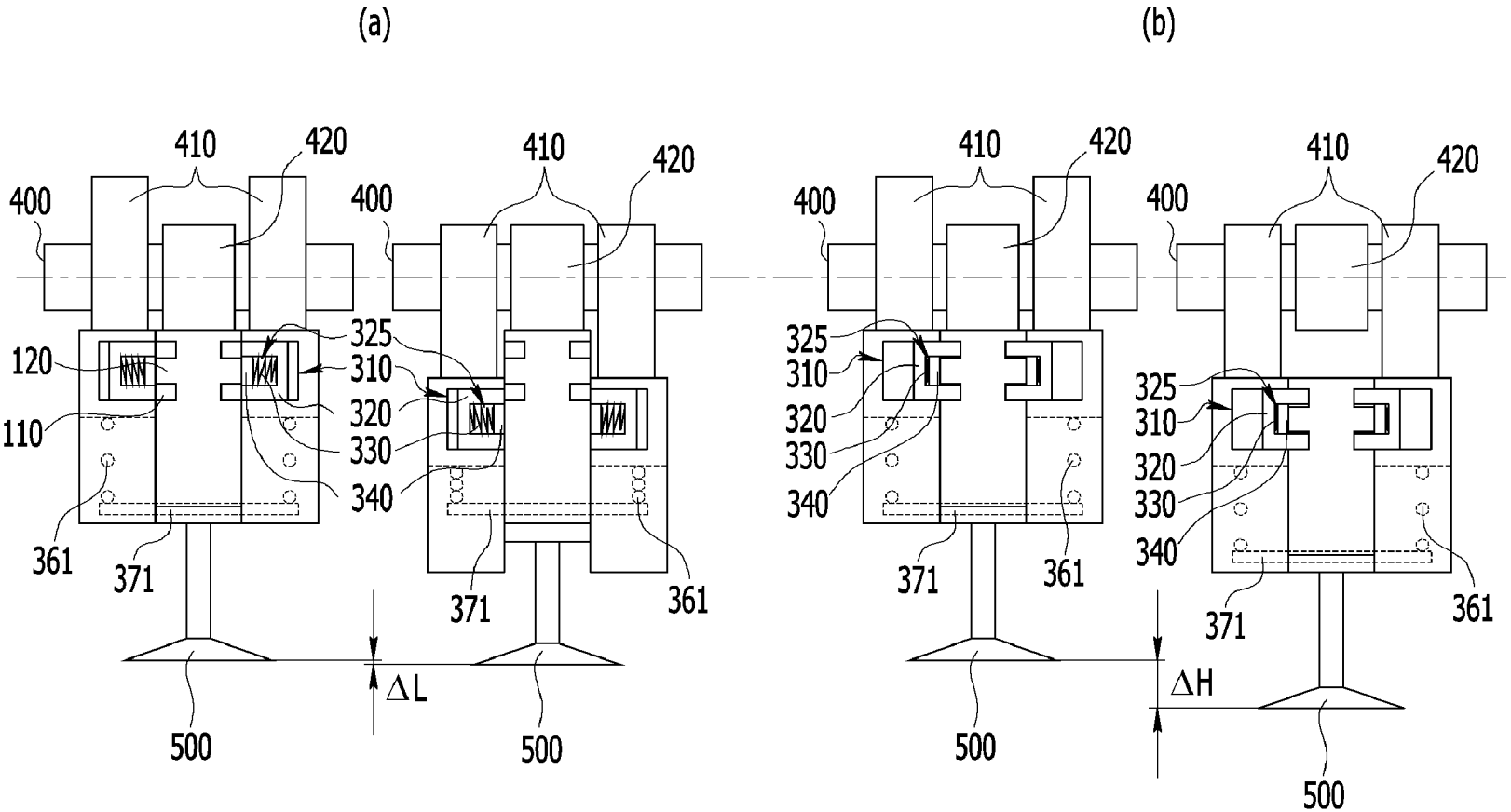
FIG. 9 is a drawing showing operation of exemplary variation of the present invention.

FIG. 9 is a drawing showing operation of exemplary variation of the first exemplary embodiment of the present invention.

Referring to FIG. 1 and FIG. 9, a variable valve lift apparatus is provided with the exemplary variation of the variable tappet according to the first exemplary embodiment of the present invention.

The variable valve lift apparatus includes a camshaft 400, a plurality of high lift cam 410 disposed to the camshaft 400 and a low lift cam 420 disposed between and the high lift cams 410. The inner tappet body 100 selectively contacts to the low lift cam 420 and the outer tappet body 200 contacts the high lift cam 410.

Comparing to the first exemplary embodiment of the present invention, in the exemplary variation, the outer tappet body 200 is elastically supported by a valve seat 371 and a lost motion spring 361 and positions of the high lift cam 410 and the low lift cam 420 are changed.

And thus, in the exemplary variation of the first exemplary embodiment of the present invention, the outer tappet body 200 outputs no useful work (lost motion) in the low lift mode.

The exemplary variation of the first exemplary embodiment of the present invention is similar to the first exemplary embodiment of the present invention, so detailed description will be omitted.

FIG. 10 is a drawing showing operation of the variable tappet according to the second exemplary embodiment of the present invention.

Referring to FIG. 10, a variable valve lift apparatus is provided with the variable tappet according to the second exemplary embodiment of the present invention.

The variable valve lift apparatus provided with the variable tappet according to the second exemplary embodiment of the present invention includes a camshaft 400, a plurality of low lift cam 420 disposed to the camshaft 200, and a high lift cam 410 disposed between the low lift cams 420. The inner tappet body 101 contacts to the high lift cam 410 and the outer tappet body 201 selectively contacts the low lift cam 420.

In the low lift mode of the variable valve lift apparatus provided with the variable tappet according to the second exemplary embodiment of the present invention, the latching pin 321 is separated from the latching member connecting hole 111, the inner tappet body 101 outputs no useful work (lost motion), and the valve 500 is opened by the low lift cam 420 forming reduced valve lift ($\Delta L$).

The exemplary embodiment of the second exemplary embodiment of the present invention is similar to the first exemplary embodiment of the present invention, so detailed description will be omitted.

Figure 11:
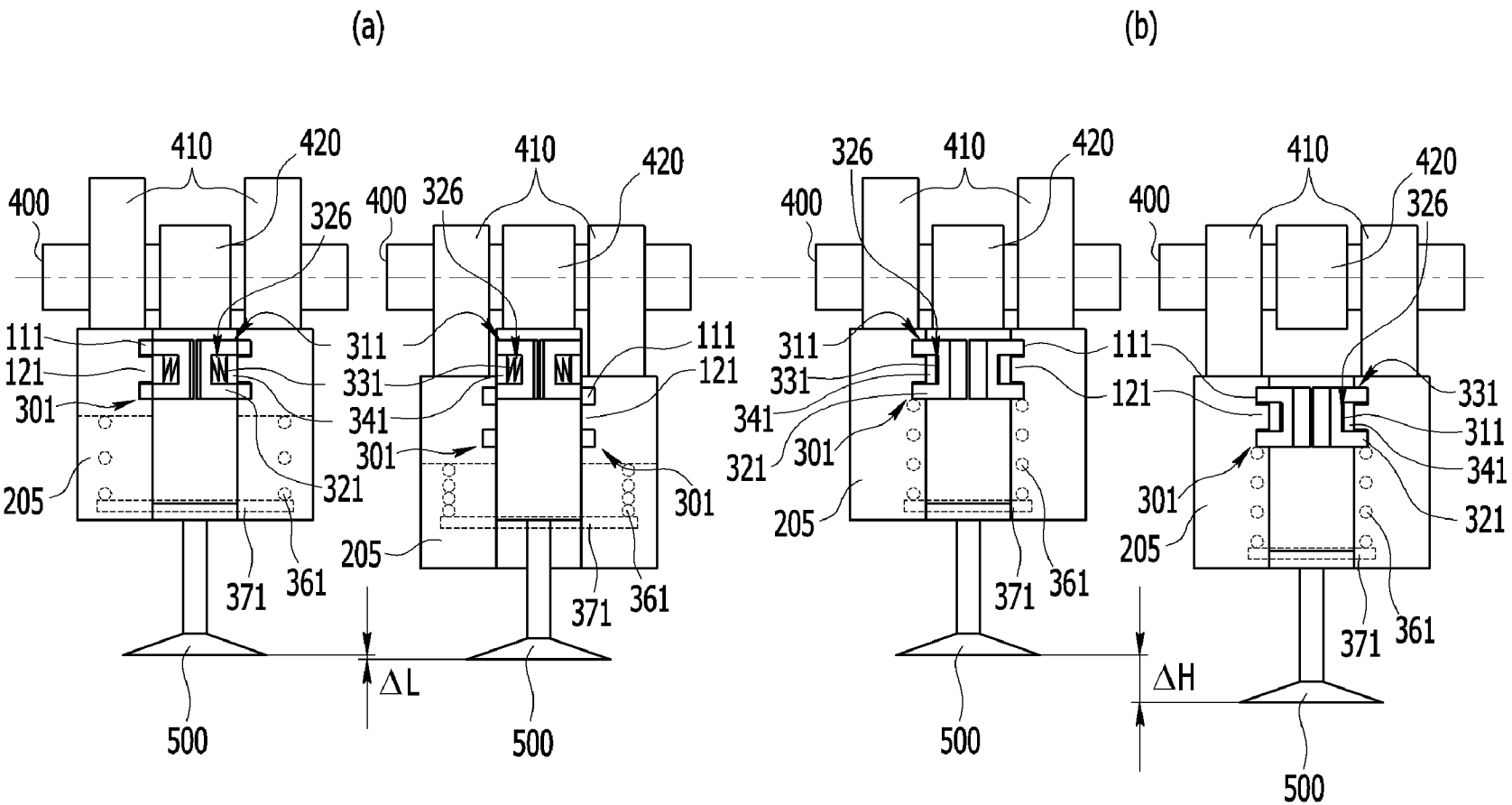
FIG. 11 is a drawing showing operation of exemplary variation of the present invention.

FIG. 11 is a drawing showing operation of exemplary variation of the second exemplary embodiment of the present invention.

Referring to FIG. 11, a variable valve lift apparatus is provided with the exemplary variation of the variable tappet according to the second exemplary embodiment of the present invention.

The variable valve lift apparatus includes a camshaft 400, a plurality of high lift cam 410 disposed to the camshaft 400 and a low lift cam 420 disposed between and the high lift cams 410. The inner tappet body 101 selectively contacts to the low lift cam 420 and the outer tappet body 201 contacts the high lift cam 410.

Comparing to the second exemplary embodiment of the present invention, in the exemplary variation, the outer tappet body 201 is elastically supported by a valve seat 371 and a lost motion spring 361 and positions of the high lift cam 410 and the low lift cam 420 are changed.

And thus, in the exemplary variation of the second exemplary embodiment of the present invention, the outer tappet body 200 outputs no useful work (lost motion) in the low lift mode.

The exemplary variation of the second exemplary embodiment of the present invention is similar to the second exemplary embodiment of the present invention, so detailed description will be omitted.

Figure 12:
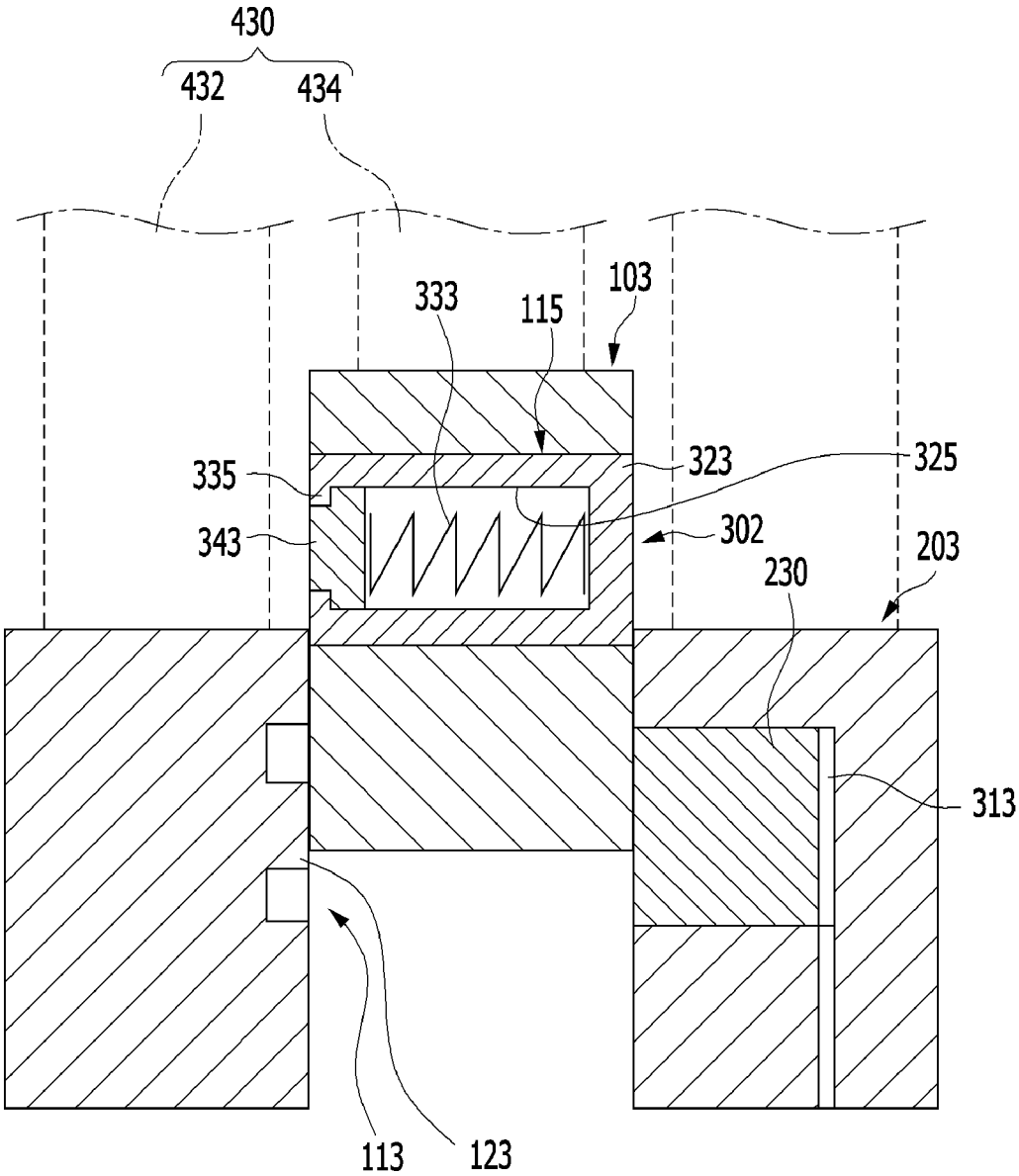
FIG. 12 is a cross-sectional view of an exemplary variable tappet according to the present invention in low lift mode.
Figure 13:
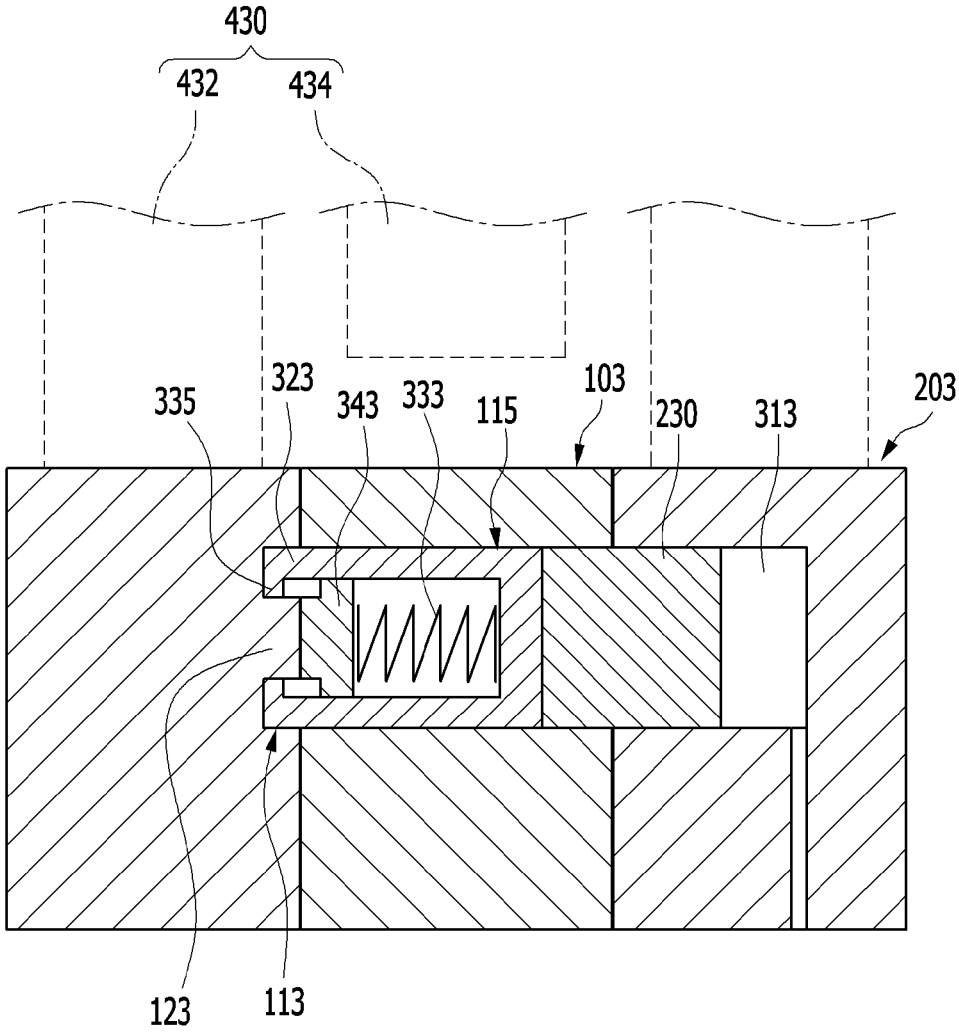
FIG. 13 is a cross-sectional view of an exemplary variable tappet according to the present invention in high lift mode.

FIG. 12 is a cross-sectional view of a variable tappet according to the third exemplary embodiment of the present invention in low lift mode and FIG. 13 is a cross-sectional view of a variable tappet according to the third exemplary embodiment of the present invention in high lift mode.

Referring to FIG. 12 and FIG. 13, A variable tappet according to the third exemplary embodiment of the present invention includes an outer tappet body 203 of which a latching member connecting hole 113 is formed thereto, a protrude portion 123 formed to the latching member connecting hole 113, an inner tappet body 103 which is disposed within the outer tappet body 203 and slidable to the outer tappet body 203 and of which a latching member guide hole 115 is formed thereto, a latching member 302 which is disposed within the latching member guide hole 115 and selectively connected to the latching member connecting hole 113 and a plunger 230 which is disposed to a hydraulic pressure chamber 313 formed to the outer tappet body 203 and selectively inserts the latching member 302 into the latching member connecting hole 113.

The latching member 302 includes a latching pin 323 having a latching pin hole 325 therein, a plate 343 which is disposed within the latching pin hole 325 of the latching pin 323 toward the protrude portion 123 and a return spring 333 which is disposed within the latching pin hole 325 and elastically supports the plate 343.

A knob 335 is formed to an end of the latching pin 323 for the plate 343 not to be separated from the latching pin 323.

A diameter of the latching pin 323 is the same as a diameter of the plunger 230.

Figure 14:
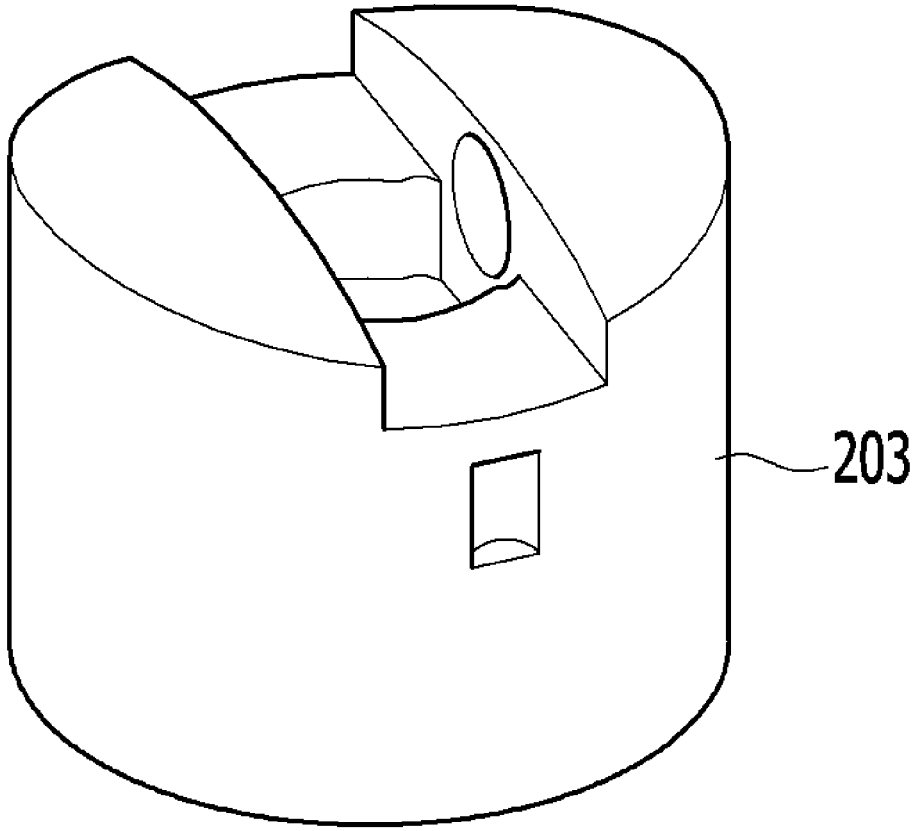
FIG. 14 is a perspective view of an outer tappet body of the exemplary variable tappet according to the present invention.
Figure 15:
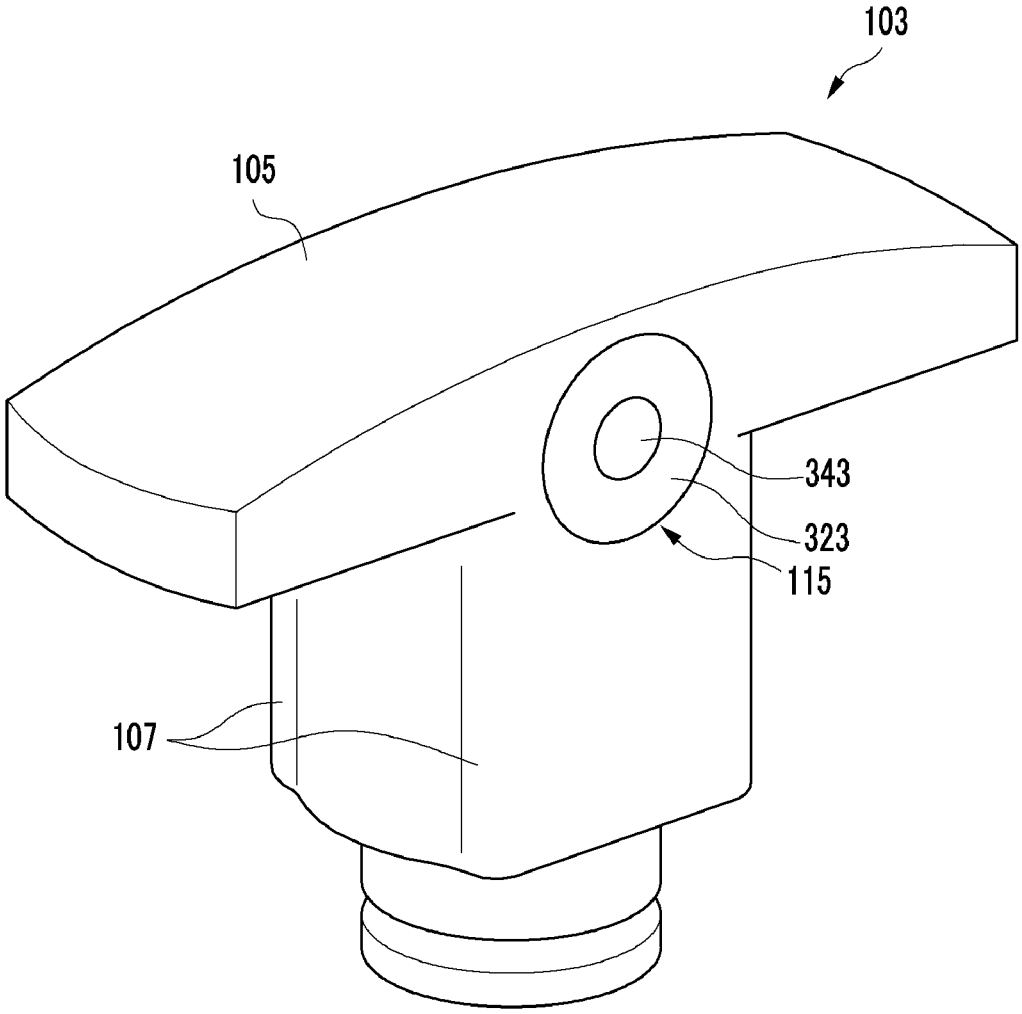
FIG. 15 is a perspective view of an inner tappet body of the exemplary variable tappet according to the present invention.
Figure 16:
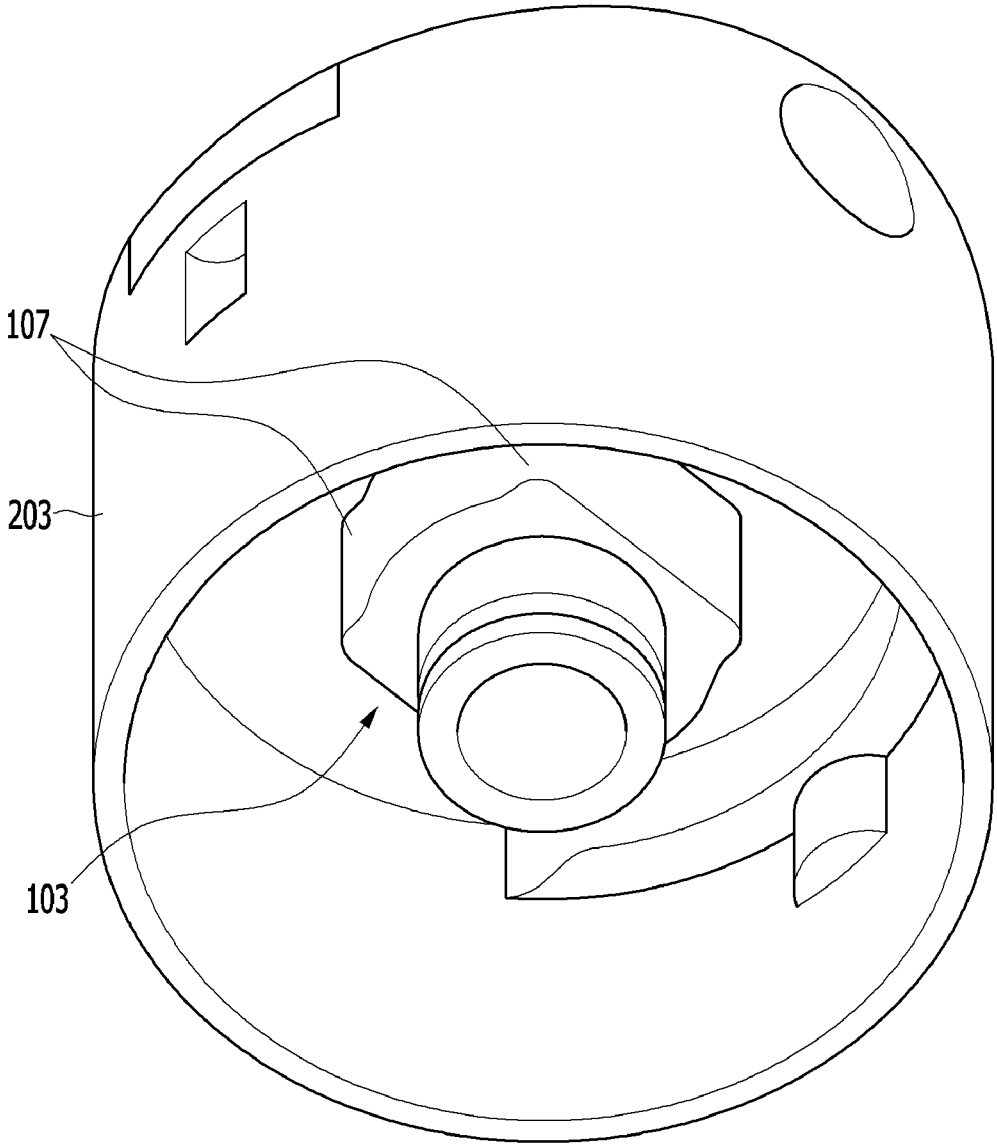
FIG. 16 is a perspective view of the inner tappet body and the outer tappet body of the exemplary variable tappet according to the present invention.

FIG. 14 is a perspective view of an outer tappet body of the variable tappet according to the third exemplary embodiment of the present invention, FIG. 15 is a perspective view of an inner tappet body of the variable tappet according to the third exemplary embodiment of the present invention, and FIG. 16 is a perspective view of the inner tappet body and the outer tappet body of the variable tappet according to the third exemplary embodiment of the present invention.

Figure 17:
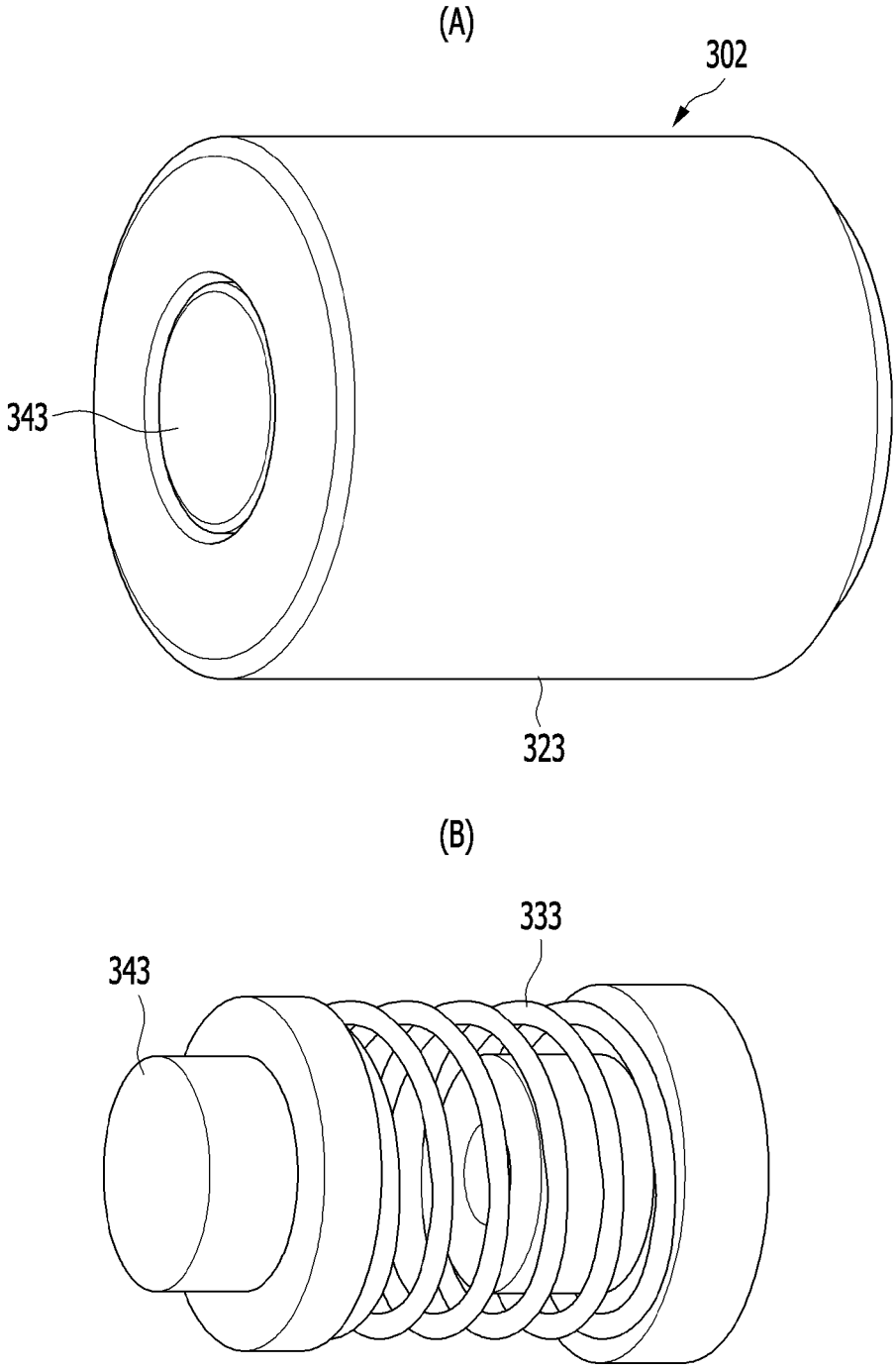
FIG. 17 is a drawing showing a latching member of the exemplary variable tappet according to the present invention.
Figure 18:
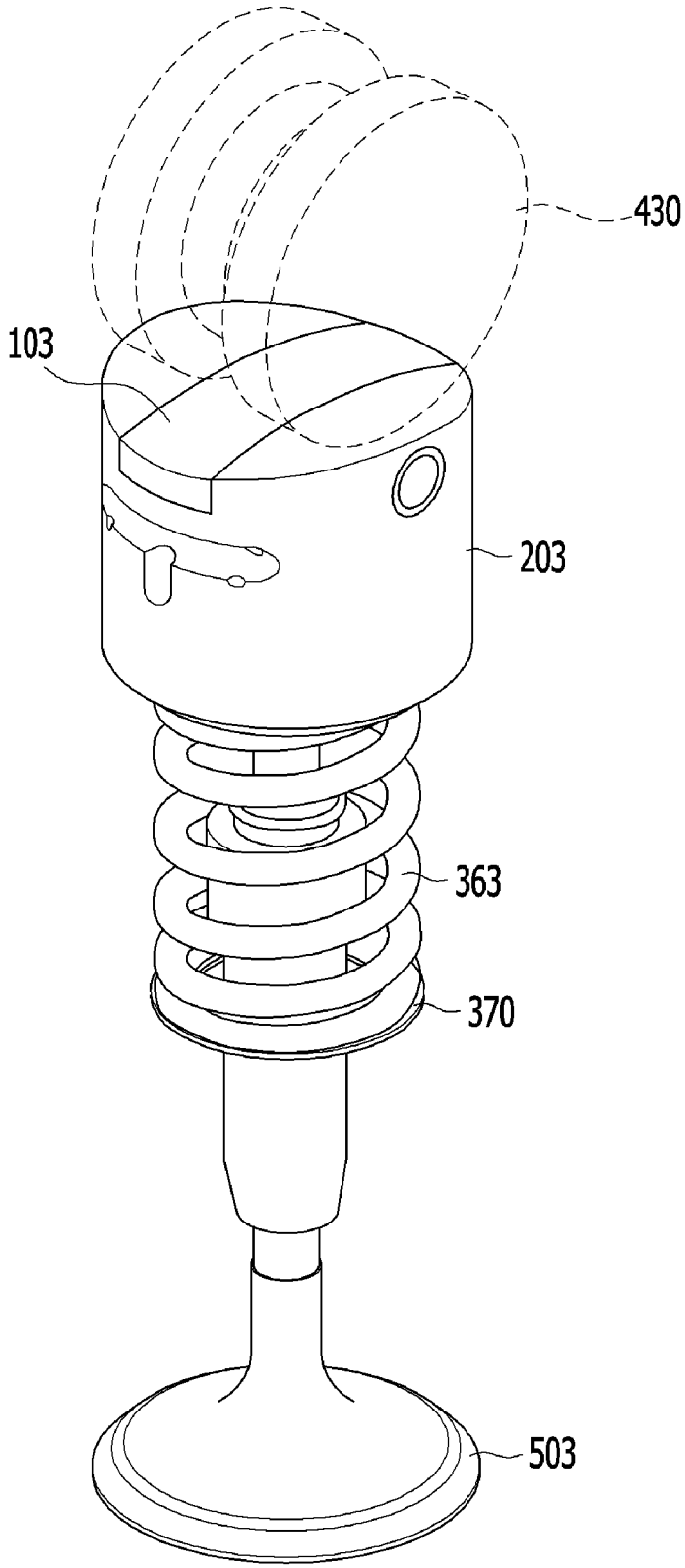
FIG. 18 is a perspective view of an exemplary variable valve lift apparatus provided with the exemplary variable tappet according to the present invention.

FIG. 17 is a drawing showing a latching member of the variable tappet according to the third exemplary embodiment of the present invention and FIG. 18 is a perspective view of a variable valve lift apparatus provided with the variable tappet according to the third exemplary embodiment of the present invention.

Referring to FIG. 14 to FIG. 18, an upper surface 105 of the inner tappet body 103, which contacts a cam 430, is elongatedly formed along rotation direction of the cam 430. And thus, closing of an intake valve may be delayed (LIVC, Late Intake Valve Closing) so that pumping loss may be reduced and thermal efficiency may be enhance due to increasing of compression ratio.

A guide protrude portion 107 is formed to the inner tappet body 103 along length direction of the variable tappet to guide the inner tappet body 103.

The outer tappet body 203 is elastically supported by a lost motion spring 363 and a lost motion spring plate 370 is disposed under the lost motion spring 363.

A variable valve lift apparatus is provided with the variable tappet according to the third exemplary embodiment of the present invention.

The variable valve lift apparatus provided with the variable tappet according to the third exemplary embodiment of the present invention includes a high lift cam 432, the outer tappet body 203 contacting the high lift cam 432, a low lift cam 434, the inner tappet body 103 selectively contacting the low lift cam 434, the latching member 302 and the plunger 230

Hereinafter, referring to the drawings, operations of the variable tappet according to the third exemplary embodiment of the present invention will be described.

In general mode (in the high lift mode), as shown in FIG. 13, hydraulic pressure is supplied to the hydraulic pressure chamber 313 formed to the outer tappet body 203 and the plunger 230 pushes the latching pin 323. And then the protrude portion 123 pushes the plate 343 to be inserted into the latching pin 323.

And thus, the latching pin 323 is inserted into the latching member connecting hole 113 and the inner tappet body 103 and the outer tappet body 203 reciprocate integrally by rotation of the high lift cam 432.

That is, a valve 503 is opened by the high lift cam 432.

In a low load range, as shown in FIG. 12, the low lift mode is operated.

In the low lift mode, the hydraulic pressure in the hydraulic pressure chamber 313 is released, the latching pin 323 is separated from the latching member connecting hole 113 by restoring force of the return spring 333, and the inner tappet body 103 and the outer tappet body 203 independently moves.

That is, the valve 503 is opened along reciprocation of the inner tappet body 103 by the rotation of the low lift cam 434 and the outer tappet body 203 reciprocated by rotation of the high lift cam 432 outputs no useful work (lost motion).

The knob 335 formed to the end of the latching pin 323 prevents the plate 343 from separating from the latching pin 323 and thus interference between the inner tappet body 103 and the outer tappet body 203 may be prevented.

The diameter of the latching pin 323 is the same as the diameter of the plunger 230 so that manufacturing of the variable tappet is simplified and the latching pin 323 is hollow so as to reduce weight.

According to the first to third exemplary embodiments of the present invention, the variable tappet may be simply manufactured, easily modified and productivity and design freedom of a valve train and a cylinder head may be enhanced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable tappet comprising:

an inner tappet body of which a latching member connecting hole is formed thereto;

a protrude portion formed in the latching member connecting hole;

an outer tappet body which is disposed around the inner tappet body and slidable to the inner tappet body; and a latching member which is slidably mounted to the outer tappet body and selectively connected to the latching member connecting hole;

wherein the latching member comprises:

a latching pin of which a latching pin hole is formed therein toward the inner tappet body and which is slidably disposed within a hydraulic pressure chamber formed in the outer tappet body, wherein a hydraulic pressure supply portion selectively supplies hydraulic pressure to the hydraulic pressure chamber to push the latching pin;

an elastic member disposed within the latching pin hole; and a plate which is slidably disposed within the latching pin hole and elastically supported by the elastic member.

2. The variable tappet of claim 1, wherein a diameter of the plate is larger than distance between the latching pin connecting hole and the protrude portion.

3. The variable tappet of claim 1, wherein:

the outer tappet body is connected to a valve; and the inner tappet body is elastically supported by a lost motion spring.

4. The variable tappet of claim 1, wherein:

the inner tappet body is connected to a valve; and the outer tappet body is elastically supported by a lost motion spring.

5. A variable tappet comprising:

an inner tappet body;

an outer tappet body which is disposed around the inner tappet body and slidable to the inner tappet body and of which a latching member connecting hole is formed thereto;

a protrude portion formed in the latching member connecting hole; and a latching member which is slidably disposed to the inner tappet body and selectively connected to the latching member connecting hole;

wherein the latching member comprises:

a latching pin of which a latching pin hole is formed therein toward the outer tappet body and which is disposed within a hydraulic pressure chamber, wherein the hydraulic pressure chamber is formed to the inner tappet body and hydraulic pressure is selectively supplied thereto by a hydraulic pressure supply portion;

an elastic member disposed within the latching pin hole; and a plate which is slidably disposed within the latching pin hole and elastically supported by the elastic member.

6. The variable tappet of claim 5, wherein a diameter of the plate is larger than distance between the latching pin connecting hole and the protrude portion.

7. The variable tappet of claim 5, wherein:

the outer tappet body is connected to a valve; and the inner tappet body is elastically supported by a lost motion spring.

8. The variable tappet of claim 5, wherein:

the inner tappet body is connected to a valve; and the outer tappet body is elastically supported by a lost motion spring.

9. A variable tappet comprising:

an outer tappet body of which a latching member connecting hole is formed thereto;

a protrude portion formed in the latching member connecting hole;

an inner tappet body which is disposed within the outer tappet body and slidable to the outer tappet body and of which a latching member guide hole is formed thereto;

a latching member which is slidably disposed within the latching member guide hole and selectively connected to the latching member connecting hole; and a plunger which is disposed to a hydraulic pressure chamber formed to the outer tappet body and selectively inserts the latching member into the latching member connecting hole;

wherein the latching member comprises:

a latching pin of which a latching pin hole is formed therein toward the outer tappet body and which is selectively connected to the latching member connecting hole;

a plate which is slidably disposed within the latching pin hole toward the protrude portion; and an elastic member which is disposed within the latching pin hole and elastically supports the plate therein.

10. The variable tappet of claim 9, wherein a knob is formed to an end of the latching pin for the plate not to be separated from the latching pin.

11. The variable tappet of claim 9, wherein a diameter of the latching pin is substantially same as a diameter of the plunger.

12. The variable tappet of claim 9, wherein an upper surface of the inner tappet body, which contacts a cam, is elongatedly formed along rotation direction of the cam.

13. The variable tappet of claim 9, wherein a guide protrude portion is formed to the inner tappet body along length direction of the variable tappet and slidably coupled to the outer tappet body.

* * * * *